United States Patent [19]

Bakeman, Jr. et al.

[11] 3,983,552

[45] Sept. 28, 1976

[54] PILFERAGE DETECTION SYSTEMS

[75] Inventors: Paul E. Bakeman, Jr., Elnora; Albert L. Armstrong, Latham, both of N.Y.

[73] Assignee: American District Telegraph Company, Jersey City, N.J.

[22] Filed: Jan. 14, 1975

[21] Appl. No.: 540,950

[52] U.S. Cl. ..... 340/280; 340/258 C; 317/157.5 R

[51] Int. Cl.[2] ..... G08B 13/22

[58] Field of Search ..... 340/280, 258 C, 258 R; 317/157.5 R, 157.5 PM, 157.5 MR

[56] References Cited

UNITED STATES PATENTS

| | | | |
|---|---|---|---|
| 1,667,422 | 4/1928 | Lewellyn | 317/157.5 R |
| 2,962,560 | 11/1960 | Folse | 317/157.5 MR |
| 3,292,080 | 12/1966 | Trikilis | 324/41 |
| 3,418,613 | 12/1968 | Trikilis | 335/284 |
| 3,631,442 | 12/1971 | Fearon | 340/258 R |
| 3,665,449 | 5/1972 | Elder et al. | 340/280 |
| 3,747,086 | 7/1973 | Peterson | 340/280 |
| 3,754,226 | 8/1973 | Fearon | 340/280 |
| 3,790,945 | 2/1974 | Fearon | 340/280 |
| 3,820,103 | 6/1974 | Fearon | 340/280 |
| 3,820,104 | 6/1974 | Fearon | 340/280 |

FOREIGN PATENTS OR APPLICATIONS

| | | |
|---|---|---|
| 763,681 | 5/1934 | France |

*Primary Examiner*—Glen R. Swann, III

*Attorney, Agent, or Firm*—Charles B. Smith; Robert R. Jackson

[57] ABSTRACT

In a pilferage detection system employing apparatus for generating a magnetic field of alternating polarity and predetermined fundamental frequency through which articles subject to pilferage must pass to leave a protected area and a magnetic marker associated with each article in the protected area, markers are provided which generate both odd and even harmonics of the fundamental frequency in response to the alternating magnetic field when the marker is active (i.e., a control element of the marker is magnetized) and which generate only odd harmonics of the fundamental frequency when the marker is inactive. The presence of an active marker in the alternating magnetic field is therefore detected by detecting a predetermined even harmonic of the fundamental frequency. Apparatus is also provided for demagnetizing the control element of the marker associated with an article authorized for removal from the protected area to permit that article to pass through the alternating magnetic field undetected.

37 Claims, 18 Drawing Figures

PILFERAGE DETECTION SYSTEMS

BACKGROUND OF THE INVENTION

This invention relates to pilferage detection systems, and more particularly to pilferage detection systems in which a magnetic marker placed in or on an article subject to pilferage is detected by detection circuitry if the article is removed from a protected area unless the marker is first removed from the associated article or deactivated.

The problem of pilferage of merchandise from retail stores, books from libraries, and the like is well known. Many different types of systems have been devised in an attempt to deal with this problem. These systems have met with varying degrees of success. Among the most promising pilferage detection systems are those in which a magnetic "marker" of any of several types is placed in or on articles subject to pilferage. Unless the marker is removed or modified in some way, presumably when an article is authorized for removal from the protected area (e.g., sold, in the case of merchandise in a store, or checked out, in the case of books in a library), the marker is detected as the article is carried to or through the exit from the protected area.

Among the earliest systems of this type are those shown in French patent 763,681 issued to P. A. Picard in 1934. In the Picard systems, a transmitting antenna coil is driven by an alternating current (AC) signal having a predetermined fundamental frequency. A receiving antenna is disposed adjacent the transmitting antenna and both antennas are located near the exit from a protected area so that a person leaving the protected area must pass through the electromagnetic field set up by the transmitting antenna. The transmitting and receiving antennas are arranged so that there is normally no net signal induced in the receiving antenna (i.e., the transmitting antenna is balanced relative to the receiving antenna). When a person enters the electromagnetic field of the transmitting antenna carrying a piece of magnetic material, the balance of the transmitting antenna is disturbed and a net signal is induced in the receiving antenna. The nature of the induced signal depends on the characteristics of the magnetic material. According to Picard, if the magnetic material is of moderate permeability (e.g., iron, steel, or nickel) and is capable of being saturated by the field of the transmitting antenna, the induced signal exhibits the fundamental frequency and several lower order odd harmonics of the fundamental frequency (e.g., the third and fifth harmonics of the fundamental frequency). If, on the other hand, the magnetic material is of high permeability (e.g., Permalloy, mu-metal, or Permafy), the induced signal also includes higher order odd harmonics of the fundamental frequency (e.g., the ninth, eleventh, etc., harmonics). By appropriately filtering the signal induced in the receiving antenna, the presence of particular magnetic materials can be detected by the presence of particular odd harmonics of the fundamental frequency in the induced signal. Since most people do not ordinarily carry materials having the magnetic characteristics of Permalloy, Picard proposes the use of a piece of Permalloy in or on articles as a marker to detect pilferage of those articles. Detection of one or more of the higher order odd harmonics characteristic of Permalloy in the signal induced in the receiving antenna can then be used to indicate that an article with a marker is being removed from the protected area.

U.S. Pat. No. 3,665,449 issued to J. T. Elder et al on May 23, 1972 shows pilferage detection systems in which magnetic markers composed of one, two, or more elements are employed to produce signals in a high frequency band (e.g., above 1000Hz) when subjected to a low frequency alternating magnetic field (e.g., 60Hz). The Elder et al systems do not detect particular harmonics of the fundamental frequency, but rather detect all frequencies in a given band. Where a marker includes two or more elements, Elder et al suggest that these elements can be of different permeabilities to produce output signals even more complex and distinctive than those produced by a marker of substantially uniform permeability. Elder et al also suggest that one element of a marker having two or more elements can be a "control" element which is remanently magnetizable. When the control element is demagnetized, the marker is sensitized or activated (i.e., produces the characteristic output signals associated with the reversal of magnetic polarity by the other marker element or elements). When the control element is magnetized, the marker is desensitized or deactivated (i.e., the other marker element or elements are prevented from reversing polarity and therefore produce no output signal, or reverse polarity in such a different fashion that the output signal is not recognized as that of an active marker).

U.S. Pat. No. 3,631,442 issued to R. E. Fearon on Dec. 21, 1971 and U.S. Pat. No. 3,747,086 issued to G. Peterson on July 17, 1973 (a "division" of the application on which the Fearon patent issued) show pilferage detection systems similar to those discussed above and employing magnetic markers having three elements, two of which are remanently magnetizable control elements (see, for example, FIG. 11 of the Fearon patent). As described by Fearon and Peterson, such markers have a number of possible states depending on the magnetization of the control elements. In general, magnetization of the control elements causes the marker to produce even as well as odd harmonics of an applied fundamental frequency. Fearon and Peterson therefore suggest determining the state of the marker by detecting a ratio of selected even and odd harmonics of the fundamental frequency. If both control elements are left strongly magnetized in the same direction, the marker is silent (i.e., the polarity of the third element does not change in response to the applied field) and the marker cannot be detected (i.e., the marker is deactivated). Peterson also describes a system employing a magnetic marker having two elements, one of which is remanently magnetizable (see column 12, lines 40–66 of the Peterson patent). In this embodiment, as described by Peterson, the marker produces detectable odd harmonics of the fundamental frequency if the control element is unmagnetized and is silent or deactivated if the control element is magnetized.

There are various defects associated with all of the foregoing systems. In the Picard system the marker is not controllable (i.e., there is no means of deactivating a marker). The marker must therefore be either removed or destroyed when the associated article is authorized for removal from the protected area or some other means must be provided for permitting authorized removal of articles from the protected area. If the marker is to be removed or destroyed, it must be placed on the protected article where it can be easily located.

In general, this will make it possible for anyone to locate and tamper with the marker. The Picard system may also give false alarms in response to large pieces of magnetic materials other than Permalloy tags. The systems shown by Elder et al employ extremely complicated receiving apparatus including both frequency-domain and time-domain filtering. In addition, the Elder et al markers employing remanently magnetizable control elements can be deactivated or silenced completely by magnetizing the control elements. Magnetization of a control element is a relatively simple operation, requiring only the manipulation of a sufficiently strong magnet. Accordingly, it may be relatively easy to tamper with these markers using a simple magnet. Accidental demagnetization of the control elements of these markers may also occur in the presence of large magnetic or electromagnetic fields such as those frequently occurring near electric motors and other electrical or electronic appliances. This may result in reactivation of deactivated markers, thereby giving rise to false alarms. The Fearon and Peterson systems employing markers with magnetizable control elements are equally subject to unauthorized deactivation through the use of magnets and accidental reactivation as a result of demagnetization of the control elements. Moreover, in any system such as the Elder et al, Fearon, or Peterson systems in which a marker is deactivated by magnetizing one or more control elements, the control elements must generally be magnetized parallel to the longitudinal dimension of the other marker elements. This means that the marker must be physically located or its orientation otherwise determined before the control element or elements can be properly magnetized to deactivate the marker. This greatly complicates the deactivation procedure or the apparatus required to perform a deactivation procedure. It is an important advantage of the systems of this invention that marker deactivation is accomplished by demagnetizing the control element of a marker and that this can be accomplished without physically locating the marker and substantially without regard for the orientation of the marker relative to the deactivation apparatus.

It is therefore an object of this invention to improve and simplify pilferage detection systems employing magnetic markers.

It is a more particular object of this invention to provide pilferage detection systems employing magnetic markers which are less subject to being tampered with by magnets.

It is another more particular object of this invention to provide pilferage detection systems employing magnetic markers with reduced sensitivity to accidental interference by other electrical apparatus in the environment of the protected articles or the pilferage detection apparatus, and with reduced sensitivity to interference from other passive but magnetically non-linear objects that are likely to pass through the detection field.

It is still another more particular object of this invention to provide pilferage detection systems employing magnetic markers which can be deactivated without physically locating the marker and substantially without regard for the orientation of the marker relative to the deactivation apparatus.

Summary of the Invention

These and other objects are accomplished in accordance with the principles of this invention by providing a pilferage detection system including transmitter apparatus for generating an alternating magnetic field having a predetermined fundamental frequency and being substantially free of even harmonics of the fundamental frequency, said system further including receiver apparatus for detecting a magnetic field component in the vicinity of the transmitted field having the frequency of a predetermined even harmonic (preferably the second harmonic) of the fundamental frequency. Magnetic markers having active and inactive states are located on or in articles subject to pilferage. All of the markers are initially active. When an article carrying an active marker enters the transmitted field, the marker responds to the transmitted field by producing a magnetic field having both odd and even harmonics of the fundamental frequency. The presence of the active marker is therefore detected by the receiver apparatus which detects the predetermined even harmonic of the fundamental frequency and produces an alarm signal or initiates other actiion appropriate to the occurrence of an act of pilferage. When an article is authorized for removal from the area protected by the system, the marker associated with that article is deactivated. A deactivated marker responds to the transmitted magnetic field by producing a magnetic field having substantially only odd harmonics of the fundamental frequency. Accordingly, an article with a deactivated marker can pass through the transmitted field without being detected by the receiver apparatus.

The magnetic markers employed in accordance with the principles of this invention include at least two elements having substantially different magnetic properties. The first element (sometimes referred to herein as the switching element) is a longitudinal element of a material which is magnetically relatively soft (i.e., easily magnetized). The second element (sometimes referred to herein as the control element) is of a material which is magnetically relatively hard (i.e., difficult to magnetize). The marker is active when the control element is magnetized parallel to the longitudinal axis of the switching element, thereby substantially magnetizing the switching element in the absence of other magnetic fields. The marker is deactivated by substantially demagnetizing the control element. When a deactivated marker is introduced into the alternating magnetic field produced by the above-mentioned transmitter apparatus, the switching element of the marker reverses polarity parallel to its longitudinal axis substantially symmetrically in time in response to the alternating magnetic field. Accordingly, the magnetic field produced by the deactivated marker includes substantially only odd harmonics of the fundamental frequency and the marker is not detected by the receiver apparatus as stated above. When an active marker is introduced into the alternating magnetic field, the switching element is biased to favor one polarity over the other. Accordingly, the switching element reverses polarity unsymmetrically in time in response to the alternating magnetic field and the magnetic field produced by the marker therefore includes both odd and even harmonics of the fundamental frequency. The active marker is detected by the presence of an even harmonic of the fundamental frequency.

In accordance with the principles of this invention the control element of an active marker is strong enough to substantially magnetize the switching element of the marker in the absence of other fields but is not strong enough to prevent reversal of the polarity of the switching element by a properly oriented external magnetic field of magnitude substantially less than that required to affect the magnetization of the control element. The maximum amplitude of the alternating magnetic field produced by the transmitter apparatus of the system is chosen so that the component of that field parallel to the longitudinal axis of the switching element of an active marker is strong enough to periodically reverse the polarity of that element for a substantial fraction (preferably a major fraction) of the possible locations and orientations of the marker in the alternating field. On the other hand, the maximum amplitude of the alternating field is not so great that the alternating field has any substantial effect on the magnetization of the control element of an active or inactive marker at any location or orientation in the alternating field. In a preferred embodiment of the system, the control element of a marker is magnetically saturated to activate the marker. Accordingly, the marker cannot be silenced by increasing the remanent magnetization of the control element.

The systems of this invention also include apparatus for demagnetizing the control element of a marker to deactivate the marker as mentioned above. In a preferred embodiment, this deactivation apparatus provides a magnetic field of alternating polarity, the amplitude of which gradually decreases from a value greater than the value needed to magnetically saturate the control element of a marker in the deactivating field. Preferably, this is the case substantially without regard for the location or orientation of the marker in the deactivating field so that a marker concealed on an article can be deactivated without physically locating the marker on the article or otherwise determining the orientation of the marker. Since the markers of this invention are deactivated by demagnetizing a control element and since demagnetization is a much more complicated procedure than magnetization, marker deactivation is much more difficult to accomplish in the systems of this invention than in the systems in which a marker is deactivated by magnetizing one or more control elements. Unauthorized or accidental marker deactivation is therefore much less likely to occur in the systems of this invention.

It is also to be noted that the markers of this invention are reusable simply by remagnetizing the marker control element parallel to the longitudinal axis of the switching element.

Further features of the invention, its nature and various advantages will be more apparent from the attached drawings and the following detailed description of the invention.

DETAILED DESCRIPTION OF THE INVENTION

Figure 2A:
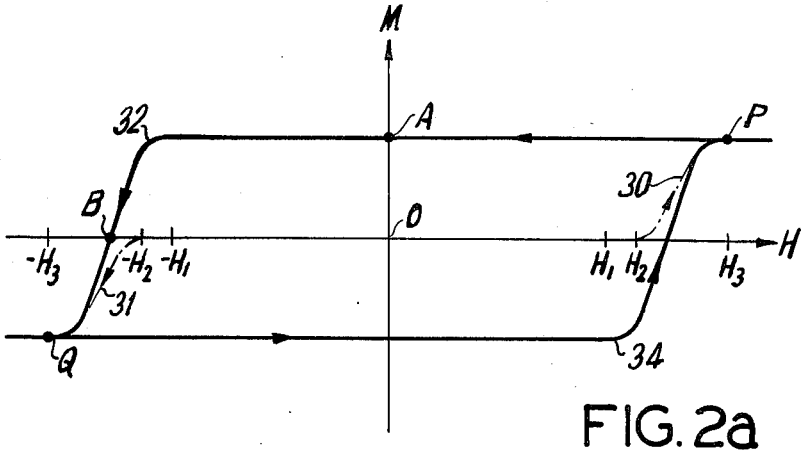
FIG. 2*a* is a plot of the magnetization M of the control element of the marker of FIG. 1 in response to an external magnetic field H.
Figure 1:
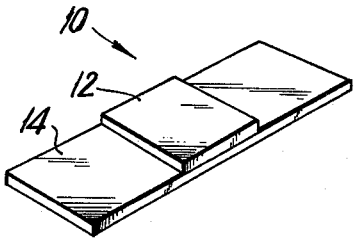
FIG. 1 is a perspective view of the magnetic portion of a marker in accordance with the principles of this invention.

FIG. 1 shows a magnetic marker 10 for use in accordance with the principles of this invention. Marker 10 includes two strips 12 and 14 of substantially different magnetic materials. Strip 12 is the control element of the marker. The behavior of strip 12 in the absence of strip 14 is illustrated in FIG. 2*a* in which M is the magnetization of the strip and H an external applied magnetic field. Initially, strip 12 is assumed to be substantially unmagnetized (i.e., $M = 0$). As H is increased from zero, there is no effect on strip 12 until $H = H_2$. At that point, M begins to increase along broken line 30. (Line 31 and abscissa $-H_2$ are shown for completeness and would represent the behavior of strip 12 if H were initially decreased from zero rather than increased as discussed above.) M continues to increase with increasing H until $H = H_3$ (corresponding to point P on the curve). At point P, strip 12 is magnetically saturated and cannot be further magnetized. There is therefore no further increase in M as H is increased beyond $H_3$. When H is decreased from a value greater than $H_3$, M remains essentially constant at the saturated value until H reaches the value $-H_1$ (i.e., M follows line 32 in the Figure). As H decreases below $-H_1$, M begins to decrease. Eventually M reverses polarity and strip 12 becomes saturated in the opposite direction (i.e., when $H = -H_3$, corresponding to point Q on the curve). If H is again increased from a value less than $-H_3$, M is essentially unchanged until $H = H_1$ (i.e., M now follows line 34 in the Figure). M then begins to increase until strip 12 is again fully saturated at $H = H_3$ (again corresponding to point P). Further traverses of the curve of FIG. 2*a* are made from point P to point Q along line 32 and from point Q to point P along line 34.

FIG. 2*a* is the well-known hysteresis curve or loop which is characteristic of most magnetic materials. The hysteresis loop of FIG. 2*a* is substantially antisymmetrical about any line through the origin O. The value of M for $H = 0$ (e.g., the ordinate OA in FIG. 2*a*) is a measure of the so-called remanent magnetization or remanence of strip 12. The reversing field required to reduce M to zero (e.g., the abscissa OB in FIG. 2*a*) is a measure of the so-called coercive force or coercivity of strip 12. The remanence and coercivity of strip 12 can be used as measures of the magnetic hardness of the material of the strip. Strip 12 is a material having a relatively high coercivity and is therefore referred to as a magnetically hard material. Once strip 12 is magnetized, relatively strong magnetic fields are required either to reverse its polarity or to demagnetize it. Strip 12 may be a piece of Vicalloy (consisting essentially of approximately 52% cobalt, 10% vanadium, and 38% iron) or the like approximately 1 inch long, 1 inch wide, and 0.002 inch thick, or Remendur (consisting essentially of approximately 49% cobalt, 3.5% vanadium, and 47.5% iron) approximately 1 inch long, 1 inch wide, and 0.001 inch thick, or other magnetically hard materials of similar geometry. Strip 12 may alternatively have the same length and width as strip 14, but the smaller size of strip 12 shown in FIG. 1 has the advantage of reducing marker cost without significantly reducing the performance of the marker. Strip 12 may be bonded to strip 14 with an adhesive resin or the like, or simply placed adjacent to strip 14.

Figure 2B:
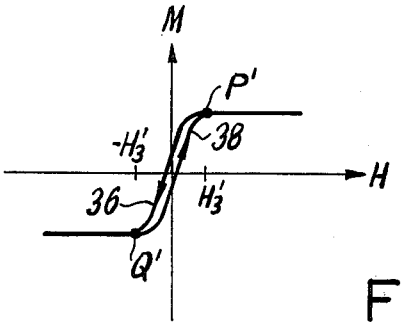
FIG. 2*b* is a plot similar to FIG. 2*a* for the switching element of the marker of FIG. 1.

Strip 14 (the switching element of the marker) also has a characteristic hysteresis curve or loop. However, the material of strip 14 is chosen to be magnetically much softer than the material of strip 12. Accordingly, the hysteresis loop for strip 14 is much less pronounced than that for strip 12. FIG. 2*b* is the M–H curve for strip 14 (plotted on approximately the same horizontal scale as FIG. 2*a*) in the absence of strip 12 or when strip 12 is completely demagnetized. Strip 14 is magnetically saturated at points P′ and Q′ (corresponding respectively to $H = H_3'$ and $H = -H_3'$). Traverses of the curve of FIG. 2*b* are made from point P′ to point Q′ along line 36 and from point Q′ to P′ along line 38. As is evident from a comparison of FIGS. 2*a* and 2*b*, the coercivity of strip 14 is much lower than the coercivity of strip 12. Accordingly, the material of strip 14 is magnetized much more easily than the material of strip 12. Where strip 12 is a piece of Vicalloy, Remendur, etc., having the dimensions given above, strip 14 may be a piece of Permalloy (consisting essentially of approximately 79% nickel, 17% iron, and 4% molybdenum) 1 inch wide, 3 inches long, and 0.002 inch thick. Strip 12 may be mounted substantially symmetrically on strip 14 as shown in FIG. 1 (i.e., strip 12 overlies the middle one-third of strip 14).

In the above discussion of the hysteresis loop for strip 14 (FIG. 2*b*), it was assumed that strip 12 was not present, or if present, was substantially unmagnetized. If strip 12 is present (as in the actual marker of FIG. 1) and strongly magnetized in a direction substantially parallel to the longest dimension of strip 14, the effect on strip 14 is generally to shift the hysteresis curve for marker 10 comprising strip 12 and strip 14 to the left or right along the H axis of the M–H graph (where H represents an external magnetic field applied to strip 14 other than the field produced by strip 12). The amount of this shift depends on many factors including the size and degree of magnetization of strip 12 (i.e., the magnetic strength of strip 12), the size and coercivity of strip 14 (i.e., the magnetic permeability of strip 14), etc. The direction of the shift (i.e., whether to the left or right along the H axis) depends on the direction of magnetization or polarity of strip 12.

Figure 2C:
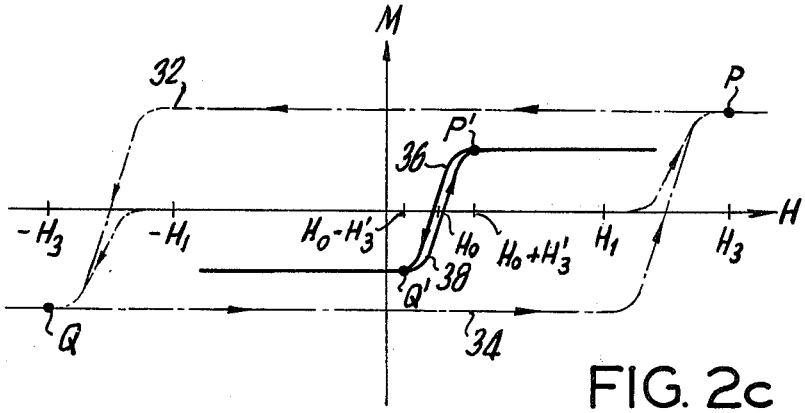
FIG. 2*c* is a plot similar to FIGS. 2*a* and 2*b* showing the effect of a magnetized control element on the switching element of the marker of FIG. 1.

FIG. 2*c* is a plot of the hysteresis curve for strip 14 shifted to the right by an amount $H_o$ as a result of the remanent magnetism of strip 12 as described above. Superimposed on FIG. 2*c* in broken lines is a partial representation of the hysteresis curve for strip 12 showing, in particular, the points P and Q for that curve and the values $\pm H_1$ and $\pm H_3$ from FIG. 2*a*. The shift in the curve for strip 14 can be more or less than that shown in FIG. 2*c*, subject to certain conditions discussed below. Similarly, the remanent magnetism of strip 12 producing the shift in the curve for strip 14 can be less than the saturated value, although in a preferred embodiment, strip 12 is near magnetic saturation when the marker is active (i.e., strip 12 of an active marker has remanent magnetization approximately equal to its saturated magnetization).

If a periodic (e.g., sinusoidal) external magnetic field H having amplitude $H_a$ (not indicated in FIG. 2*c*) less than or equal to $H_1$ and orientation approximately parallel to the longest dimension of strip 14 is applied to a marker magnetically biased as represented by FIG. 2*c*, that external field causes the magnetization of strip 14 to change as generally indicated by the hysteresis curve for strip 14 in FIG. 2*c* without having any substantial effect on the magnetization of strip 12. Assume, for example, that $H_a$ is greater than $H_o+H_3'$. The magnetization of strip 14 will then exactly traverse the hysteresis curve for strip 14 shown in FIG. 2*c* between the ordinates corresponding to $+H_a$ and $-H_a$. The state of strip 12 will be described by motion back and forth along the horizontal portion of either dotted line 32 or dotted line 34 in FIG. 2*c* (depending on the polarity of strip 12) between ordinates corresponding to $+H_a$ and $-H_a$. However, because both lines 32 and 34 are horizontal in the range from $+H_a$ (less than $H_1$) to $-H_a$ (greater than $-H_1$), M for strip 12 is not changed and strip 12 is substantially unaffected by the external field. As another example, if $H_a$ is less than $H_o+H_3'$ (but greater than $H_o-H_3'$), strip 14 traverses line 38 as H increases from $H_o-H_3'$. When H reaches the value $H_a$ and begins to decrease, strip 14 traverses a path (not shown) from the ordinate on line 38 corresponding to $H_a$ to point Q′ (when $H = H_o-H_3'$) in the region bounded by lines 36 and 38. This new path has a shape generally similar to path 36 (although it may be substantially shorter depending on the relationship of $H_a$ to $H_o+H_3'$) and converges toward line 36 as point Q′ is approached. Since in this example $H_a < H_1$, the magnetization of strip 12 is again substantially unaffected by the external field. As a third example, if $H_a$ is less than $H_o-H_3'$ for the marker represented by FIG. 2*c*, M for neither strip is substantially affected by the external field.

Returning to the example in which $H_o+H_3' < H_a < H_1$, each time the applied signal traverses the range from $H_o-H_3'$ to $H_o+H_3'$ or vice versa, M for strip 14 is radically changed. The magnetization M of strip 14 produces a proportional magnetic field $H_{in}$ (induced) in the area surrounding the marker, just as any bar magnet produces a magnetic field in the surrounding area. Each time the applied magnetic field H traverses the range from $H_o-H_3'$ to $H_o+H_3'$ or vice versa, M first goes to zero (along one of lines 36 or 38 in FIG. 2*c*) and then reverses polarity. Accordingly, $H_{in}$ first collapses to zero and is then reestablished with the opposite polarity. These changes in field $H_{in}$ can be used to induce a voltage in a wire or coil in the area of the field. Assuming the marker is appropriately oriented with respect to the receiving coil, the voltage induced in the receiving coil is generally proportional to the time rate of change of field $H_{in}$. This in turn is proportional to the first time derivative of the magnetization M of strip 14.

Figure 3A:
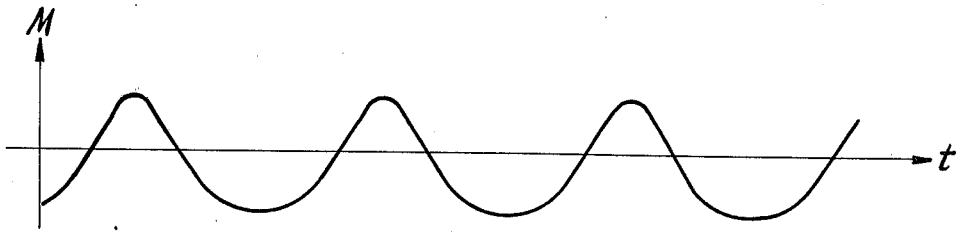
FIG. 3*a* is an idealized plot of M as a function of time for the switching element of the marker of FIG. 1 when the control element is magnetized.
Figure 3B:
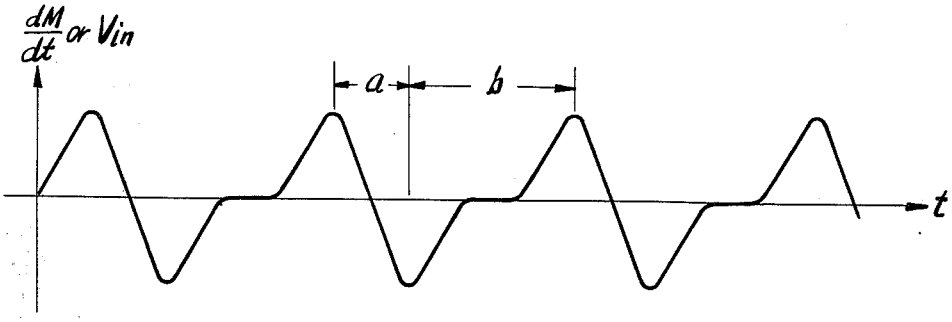
FIG. 3*b* is a plot of the first time derivative of the plot of FIG. 3*a;*

FIG. 3*a* is an idealized plot of M as a function of time *t* for strip 14 biased as shown in FIG. 2*c* and subjected to a sinusoidal external magnetic field H of frequency $f_o$ and amplitude $H_a$, where $H_o+H_3' < H_a < H_1$. FIG. 3*b* is the first time derivative of the curve shown in FIG. 3*a*. Since $H_{in}$ is proportional to M and the voltage induced in a receiving coil in field $H_{in}$ is proportional to the first time derivative of $H_{in}$, FIG. 3*b* also represents the voltage $V_{in}$ induced in the receiving coil.

Figure 4A:
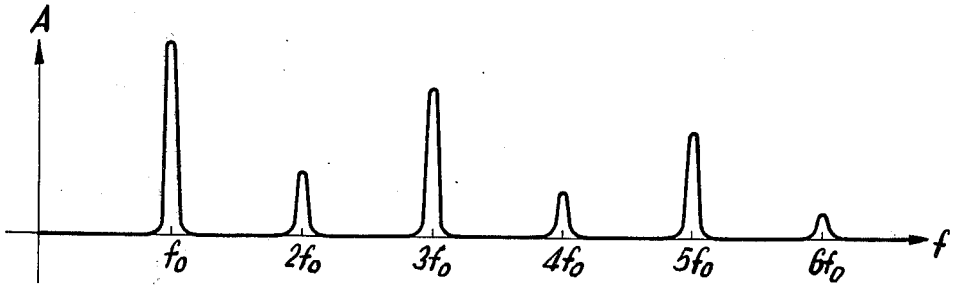
FIG. 4*a* is a plot of the frequency spectrum of the curve of FIG. 3*b;*

It should be noted that the negative-going pulses in FIG. 3*b* are not spaced midway between the positive-going pulses (i.e., $a \neq b$ in FIG. 3*b*). This asymmetry means that the signal $V_{in}$ can only be approximated by a Fourier series having even as well as odd harmonics of the fundamental frequency $f_o = (1/a+b)$. FIG. 4*a* is the frequency spectrum (amplitude A as a function of frequency *f*) of the signal $V_{in}$ of FIG. 3*b*. As shown in FIG. 4*a*, the signal of FIG. 3*b* has substantial components at both odd and even harmonics of $f_o$ (respectively $f_o$, $3f_o$, $5f_o$, etc., and $2f_o$, $4f_o$, $6f_o$, etc.). The greater the asymmetry in signal $V_{in}$ (i.e., the greater the difference between *a* and *b* in FIG. 3*b*), the higher the amount of energy present in the even harmonics of $f_o$ in signal $V_{in}$.

Figure 2D:
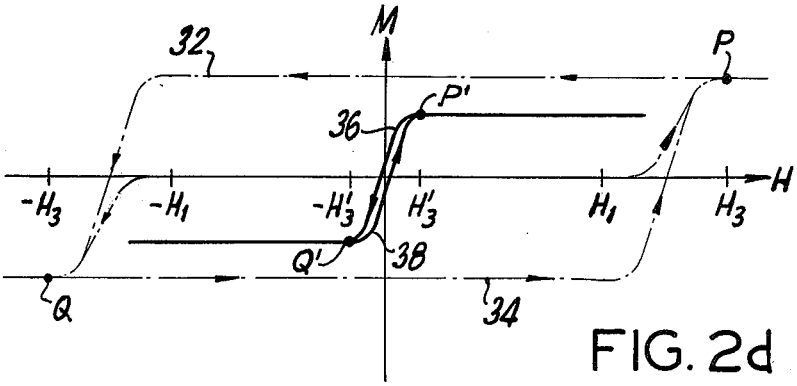
FIG. 2*d* is a composite of FIGS. 2*a* and 2*b* which is useful in explaining the behavior of the marker of FIG. 1 when the control element is demagnetized.

FIG. 2*d* is similar to FIG. 2*c*, but represents the behavior of marker 10 when strip 12 is substantially unmagnetized (i.e., when M = 0 for strip 12). Accordingly, the hysteresis curve for strip 14 is centered on the origin as in FIG. 2*b*. As in the case of FIG. 2*c*, an applied magnetic field of amplitude $H_a$ less than $H_1$ has no effect on strip 12 because, as is evident from FIG. 2*a*, magnetization of strip 12 does not begin until $H = \pm H_2$ ($H_2$ being generally of greater magnitude than $H_1$). Accordingly, a sinusoidal applied magnetic field of frequency $f_o$ and amplitude $H_a$ (greater than $H_3'$ but less than $H_1$) causes the magnetization M of strip 14 to retraverse the hysteresis curve for strip 14 shown in FIG. 2*d* between the ordinates corresponding to $H_a$ and $-H_a$ with frequency $f_o$, but has no significant effect on the magnetization of strip 12. (If $H_a$ is less than $H_3'$, the magnetization M of strip 14 traverses a smaller hysteresis loop (not shown in FIG. 2*d* but generally bounded by lines 36 and 38 in that Figure); however, the effects described below are basically the same.)

Figure 3C:
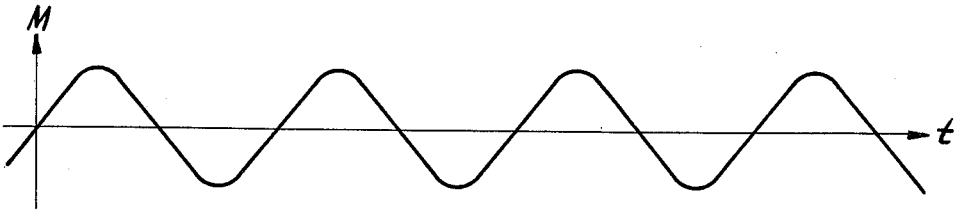
FIG. 3*c* is an idealized plot of M as a function of time for the switching element of the marker of FIG. 1 when the control element is demagnetized.
Figure 3D:
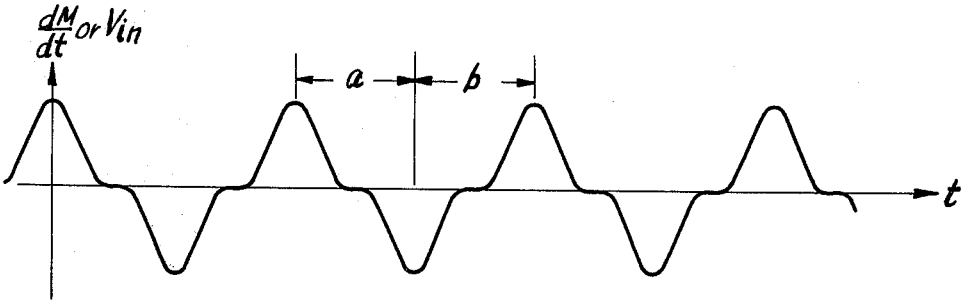
FIG. 3*d* is a plot of the first time derivative of the plot of FIG. 3*c;*
Figure 4B:
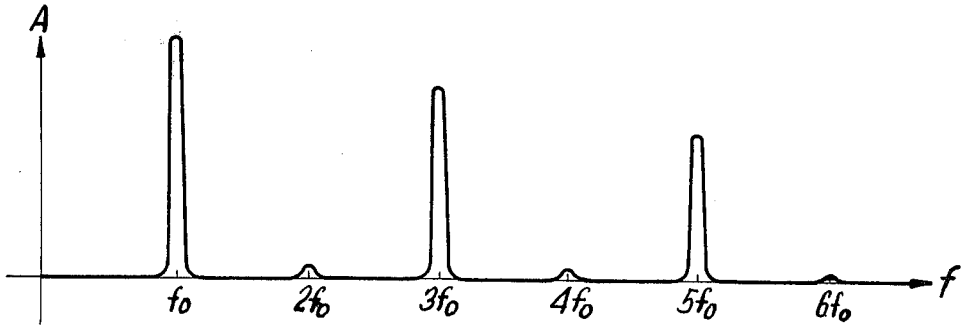
FIG. 4*b* is a plot of the frequency spectrum of the curve of FIG. 3*d;*

The magnetization M of strip 14 under these conditions is plotted as a function of time in FIG. 3*c*. FIG. 3*d* is a plot of the first time derivative of the magnetization curve of FIG. 3*c*. As in the discussion of FIGS. 3*a* and 3*b* above, the first time derivative of M is proportional to the voltage $V_{in}$ induced in a properly oriented receiving coil by the changes in the external magnetic field $H_{in}$ produced by strip 14. Since the hysteresis curve for strip 14 is centered on the origin in FIG. 2*d*, the changes in M in FIG. 3*c* occur at substantially equally spaced intervals of time. Accordingly, the positive and negative pulses in FIG. 3*d* also occur at substantially equally spaced time intervals (i.e., $a = b$ in FIG. 3*d*). The curve of FIG. 3*d* can therefore be approximated by a Fourier series having substantially only odd harmonics of the fundamental frequency $f_o$. FIG. 4*b* shows the frequency spectrum of the signal $V_{in}$ of FIG. 3*d*. As is consistent with the Fourier analysis of FIG. 3*d*, the spectrum of FIG. 4*b* is made up almost entirely of the odd harmonics of $f_o$ (i.e., $f_o$, $3f_o$, $5f_o$, etc.). There is practically no contribution from the even harmonics of $f_o$ (i.e., $2f_o$, $4f_o$, $6f_o$, etc.). The small amount of energy in the even harmonics may be due in part to the fact that a small bias may still remain due to the magnetic field of the earth or other magnetized objects.

Another way of stating the foregoing (which may also serve as a summary) is that when strip 12 is essentially unmagnetized (the condition represented by FIG. 2*d*), strip 14 switches from one polarity to the other substantially symmetrically in time in response to an external sinusoidal magnetic field. Accordingly, voltage pulses associated with the switching of strip 14 from one polarity to the other are induced in a properly oriented receiving coil in the external magnetic field produced by strip 14 at approximately evenly spaced time intervals (i.e., $a = b$ in FIG. 3*d*). The frequency spectrum of the induced signal therefore contains only odd harmonics of the frequency $f_o$ of the sinusoidal driving field. On the other hand, when strip 12 is magnetized and strip 14 is thereby magnetically biased (the condition represented by FIG. 2*c*), the switching of strip 14 from a first polarity to a second polarity is delayed in time relative to the corresponding zero-axis crossing of the applied sinusoidal driving field. Thereafter, the switching of strip 14 back to the first polarity precedes the next zero-axis crossing of the applied sinusoidal driving field. Thus, two signal pulses are induced in a receiving coil in the field of strip 14 in relatively quick succession. The next signal pulse is not induced in the receiving coil until the above-mentioned time delay after a third zero-axis crossing of the applied sinusoidal driving signal when strip 14 switches again to the second polarity. Accordingly, the signal induced in the receiving coil consists of pairs of closely spaced pulses separated by somewhat larger time intervals (see FIG. 3*b* in which $a \neq b$). A signal of this kind can only be duplicated by a Fourier series having both odd and even harmonics of the fundamental frequency $f_o$. Accordingly, the frequency spectrum of this signal includes substantial contributions at both the odd and even harmonics of $f_o$ (see FIG. 4*a*).

In accordance with the principles of this invention, the presence of a predetermined even harmonic (preferably the second harmonic) of the frequency of an applied magnetic field in the signal induced in a receiving coil is used to indicate the presence of an active (i.e., magnetically biased) marker in the applied magnetic field. The substantial absence of the predetermined even harmonic in the signal induced in the receiving coil indicates that there is no marker in the applied magnetic field or that any marker in that field has been deactivated (i.e., the control strip 12 for the marker has been substantially demagnetized). It is therefore desirable to provide a system for which these two conditions of a marker are clearly distinguishable. This involves a large number of considerations, some of which have already been mentioned. For one thing, virtually no signal is induced in the receiving coil by an active marker unless the amplitude of the component of the applied field parallel to the longest dimension of strip 14 is at least equal to $H_o-H_3'$ as shown in FIG. 2*c*. To reduce the sensitivity of the system to the orientation of a marker in the applied field, it is therefore generally desirable to provide a marker for which $H_o-H_3'$ is relatively small, preferably zero or even slightly negative, so that one of the regions of greatest non-linearity (i.e., greatest curvature) in lines 36 and 38 is close to the M axis in FIG. 2*c*. On the other hand, the strength of the even harmonics in the signal induced in the receiving coil increases as the difference between *a* and *b* in FIG. 3*b* increases. Assuming that the amplitude of the applied magnetic field component parallel to strip 14 is always greater than $H_o+H_3'$ in FIG. 2*c*, the difference between *a* and *b* in FIG. 3*b* can be increased by increasing $H_o$. This last assumption, however, is not a safe or practical one in any system in which marker orientation relative to applied field orientation is arbitrary, unless multiple mutually perpendicular fields are provided as discussed below. In any system in which there are less than three such mutually perpendicular fields, there will always be some marker orientations for which the amplitude of all the external magnetic fields are substantially less than $H_o+H_3'$. In those systems, increasing $H_o$ to increase the difference between *a* and *b* in FIG. 3*b* for some marker orientations also increases the sensitivity of the system to marker orientation (i.e., increases the fraction of possible marker orientations for which the amplitude of the component of the applied magnetic field parallel to strip 14 is less than $H_o-H_3'$ in FIG. 2*c*). It is also to be noted that if $H_o$ is selected as shown in FIG. 2*c*, the difference between *a* and *b* increases as the amplitude of the applied magnetic field component parallel to strip 14 increases, until the amplitude of that component equals $H_o+H_3'$. Thereafter, further increases in applied signal amplitude do not further increase the difference between *a* and *b*.

Another consideration already alluded to is the maximum amplitude of the applied magnetic field. In the preceding discussion, the component of the applied magnetic field of interest is the component parallel to the longest dimension of strip 14. In most cases, however, markers may pass through the applied field with any arbitrary orientation. Systems may be provided in accordance with the principles of this invention with two or three mutually perpendicular magnetic fields to reduce or even eliminate sensitivity to marker orientation. However, the cost of a system increases as the number of transmitting and receiving antennas increases. It is possible to design a system in accordance with the principles of this invention having only one transmitting and one receiving antenna and therefore only one axis of maximum applied field amplitude which is effective to detect markers for a major fraction of the possible marker orientations. The sensitivity of such a system to marker orientation is generally reduced by increasing the maximum amplitude of the applied field. On the other hand, the applied field must not be so strong that control strip 12 of an active or inactive marker traverses any substantially non-linear portion of its hysteresis curve for any orientation of the marker in the applied field. Thus, as stated above, the maximum amplitude of the applied field is necessarily less than $H_1$ in FIG. 2*c* and 2*d*. In addition, the cost of a system generally increases with increased applied field strength. At a minimum, however, the amplitude of the component of the applied field parallel to the longest dimension of strip 14 is preferably large enough to cause strip 14 of an active marker to traverse a substantial portion of at least one non-linear region of its hysteresis curve for a major fraction of the possible orientations of markers in the applied field. Accordingly, it will usually be desirable for the amplitude of the component of the applied field parallel to the longest dimension of strip 14 to be at least approximately equal to $H_o$ in FIG. 2*c*, and preferably at least approximately equal to $H_o+H_3'$, for a substantial fraction, preferably a major fraction, of the possible orientations of markers in the applied field.

As is evident from the foregoing, there are a great many considerations involved in the design of the systems of this invention. Moreover, some of these considerations are mutually conflicting so that certain system parameters must be selected to effect compromises between conflicting objectives. Within the limits discussed above, however, it is possible to design systems to meet a wide variety of needs. A particularly desirable system includes one transmitting antenna and one receiving antenna and employs markers of the materials and dimensions given above for marker 10. This is a marker for which $H_1$ is very large in comparison to $H_3'$ and which, when activated by magnetically saturating strip 12, has one region of greatest non-linearity in the hysteresis curve for strip 14 very close to the M axis (i.e., $H_o-H_3'$ in FIG. 2*c* is approximately zero or slightly negative). This marker works extremely well with the transmitting and receiving apparatus discussed in detail below to detect active markers having any of a major fraction of the possible marker orientations in the applied field and giving few, if any, false alarms in response to inactive markers or other articles in the applied field.

Figure 5:
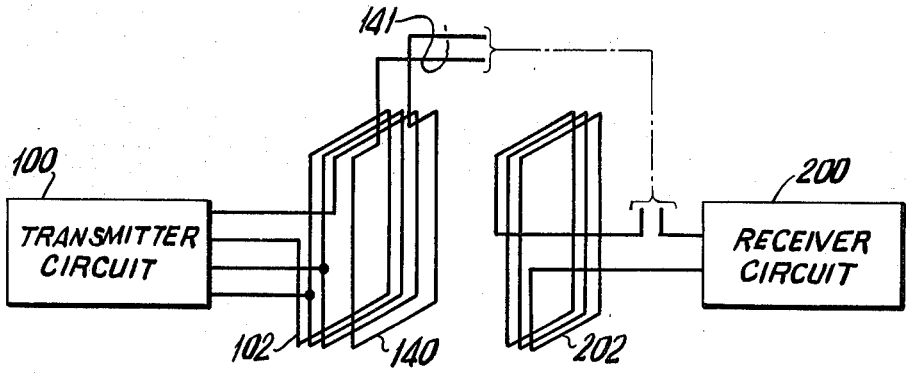
FIG. 5 is a partly perspective, partly block diagram representation of the transmitter and receiver apparatus of the system of this invention.

FIG. 5 is a partly perspective, partly block diagram representation of the basic electronic elements of a preferred embodiment of the marker detection apparatus of this invention. Although systems can be constructed in accordance with the principles of this invention having two or even three mutually perpendicular transmitter and receiver antenna systems as mentioned above, the preferred embodiment has only one transmitter antenna (with bucking coil 140) and one receiver antenna as shown in FIG. 5. Similarly, although the systems of this invention may include transmitter apparatus for generating an alternating magnetic field having any fundamental frequency $f_o$ in a wide range of frequencies and receiver apparatus for detecting any of several even harmonics of the fundamental frequency, in the system described specifically below $f_o$ is approximately 1441 Hz and the receiver apparatus detects the second harmonic of $f_o$ (i.e., approximately 2882 Hz). The apparatus shown in FIG. 5 includes transmitter circuit 100 connected to transmitter antenna coil 102 and receiver circuit 200 connected to receiver antenna coil 202. Bucking coil 140 is wound with transmitter coil 102 and is connected in series with receiver coil 202 by way of leads 141. Coils 102 and 202 are located in parallel planes at a location such that any article to be removed from the area protected by the system must pass between the coils. For example, coils 102 and 202 may be located on opposite sides of the exit from the protected area and may be approximately 5 to 8 feet apart to provide a reasonably open and unobstructed exitway. Alternatively or in addition, transmitting and receiving coils similar to those shown in FIG. 5 may be disposed opposite one another in the floor and ceiling respectively below and above the exitway. Coil 102 may be, for example, 8 turns of copper strap approximately 1 inch wide by 3/32 inch thick wound on a rectangular frame 8 feet wide by 8 feet high. Coil 202 may be 30 turns of 22 gauge copper wire on a rectangular frame of similar size.

Figure 6:
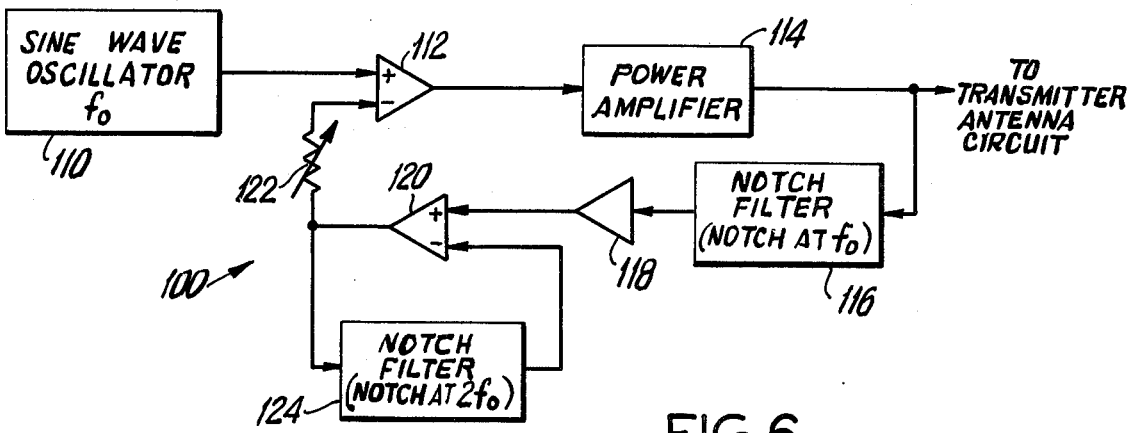
FIG. 6 is a schematic block diagram showing a portion of the transmitter apparatus of this invention in greater detail.

As shown in FIG. 6, transmitter circuit 100 includes sine wave oscillator 110 for producing a sinusoidal signal of frequency $f_o$. This signal is preferably stable and as free of other frequency components as possible. $f_o$ is preferably a frequency which is not a harmonic of the ambient electrical power frequency. 1441 Hz is therefore a convenient frequency for $f_o$ when the ambient power frequency is 60 Hz. Oscillator 110 may be a commercially available oscillator and may have a frequency adjustment to account for minor changes in operating conditions. An example of a suitable oscillator is Model 434, Precision Sinewave Oscillator available from Frequency Devices Inc., Haverhill, Massachusetts.

The output signal of oscillator 110 is applied to the positive input terminal of operational or summation amplifier 112. Amplifier 112 combines and amplifies the signals applied to its two input terminals, giving each signal the algebraic sign associated with that input terminal in FIG. 6. The output signal of amplifier 112 is applied to power amplifier 114 where the power of the applied signal is substantially amplified to produce a signal suitable for driving the transmitter antenna circuit. Since the systems of this invention detect an active marker by detecting a predetermined even harmonic of the fundamental frequency in the magnetic field produced by an active marker in the transmitted field, the transmitted field is preferably substantially free of even harmonics of the fundamental frequency. In particular, it is especially important that the transmitted field be essentially free of the particular even harmonic detected by the receiver apparatus (i.e., the second harmonic of $f_o$ in the specific embodiment shown in the Figures). Accordingly, amplifier 114 is preferably highly linear so that the signal produced is as free as possible of frequency components other than $f_o$. An example of a suitable amplifier is the Crown DC-300 power amplifier available from Crown International, Elkhart, Indiana. This is a two-channel amplifier which can be connected in push-pull relationship with the transmitting antenna circuit as shown in FIG. 7 and discussed in greater detail below.

Despite the very good linearity of power amplifiers such as the one mentioned above, it may still be desirable to provide a feedback loop as shown in FIG. 6 to further suppress extraneous frequency components, and particularly any frequency component at $2f_o$, in the output signal of amplifier 114. Accordingly, the output signal of amplifier 114 is applied to notch filter 116 having a notch at $f_o$. Notch filter 116 may be, for example, a twin-T filter which passes substantially all signal frequencies in the output signal of amplifier 114 except $f_o$. The output signal of notch filter 116 is amplified by operational amplifier 118 and the amplified signal is applied to the positive input terminal of operational amplifier 120. The output signal of amplifier 120 is applied to the negative input terminal of operational amplifier 112 through variable feedback adjuster (e.g., variable resistor) 122 and to notch filter 124 having a notch at $2f_o$. The output signal of notch filter 124 is applied to the negative input terminal of operational amplifier 120. Accordingly, elements 120 and 124 operate to favor the $2f_o$ frequency component in the output signal of power amplifier 114. As mentioned above, the output signal of operational amplifier 120 is applied to the negative input terminal of operational amplifier 112 through feedback adjuster 122. Accordingly, any $2f_o$ frequency component in the output signal of power amplifier 114 is fed back to the input of amplifier 114 in phase opposition to the output signal component of frequency $2f_o$, thereby tending to cancel or strongly suppress that output signal component. The signal applied to the transmitter antenna circuit is therefore a nearly pure sinusoidal signal of frequency $f_o$. In particular, any $2f_o$ frequency component of that signal is at least approximately 100dB lower than the $f_o$ component.

Figure 7:
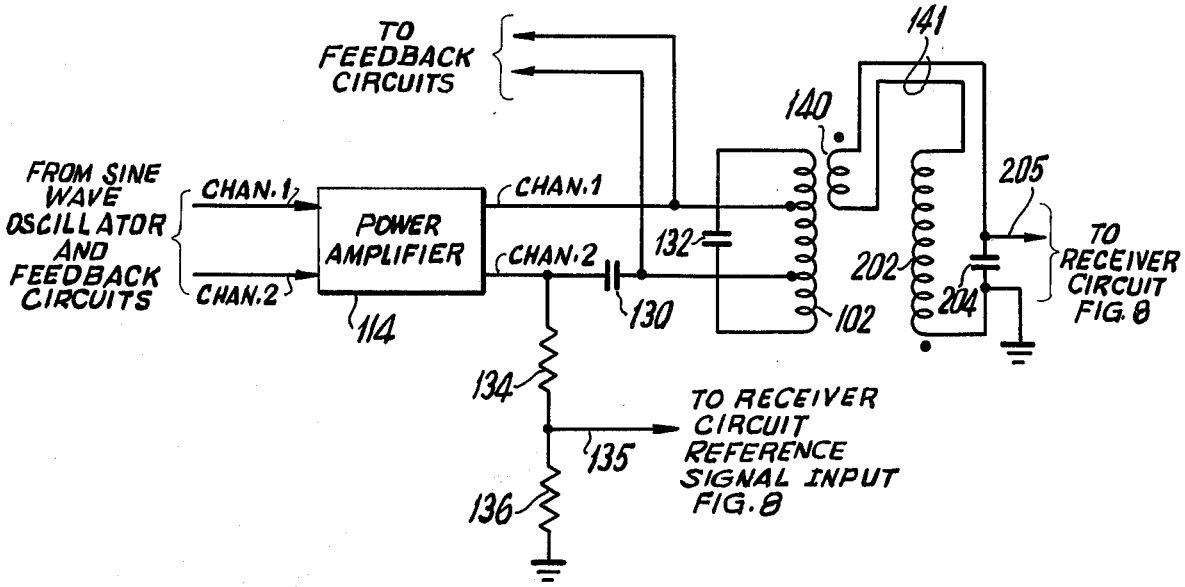
FIG. 7 is a schematic block diagram showing the transmitter and receiver antenna circuits of this invention in greater detail.

As shown in FIG. 7 and mentioned above, power amplifier 114 may advantageously be a two-channel amplifier connected in push-pull relationship with transmitter coil 102. Accordingly, amplifier output channel 1 is connected to an interior point on coil 102 and amplifier output channel 2 is connected to another interior point on coil 102 by way of AC coupling capacitor 130. The ends of coil 102 are connected across tuning capacitor 132 selected to provide a transmitter antenna circuit resonant at $f_o$. With a transmitter coil 102 constructed as described above, tuning capacitor 132 may have a value of approximately 50 microfarads. The output signals of power amplifier channels 1 and 2 are also fed back for mixing with the sine wave oscillator output signal through feedback circuits like the one described above in the discussion of FIG. 6. The output signal of amplifier channel 2 also serves as a source of a low-level reference signal on lead 135 for use in receiver circuit 200 as described in detail below. This reference signal is provided by connecting amplifier output channel 2 to ground across voltage dividing resistors 134, 136. Lead 135 is connected between resistors 134 and 136. Lead 135 is preferably shielded to prevent interference between the signal on that lead and the rest of the apparatus.

As further shown in FIG. 7, transmitter coil 102 is preferably wound with a bucking coil 140 having a lower inductance than coil 102. Transmitter coil 102 induces a bucking signal of frequency $f_o$ in coil 140. Coil 140 is connected in series with receiver coil 202 in such a way that the buckling signal in coil 140 is in phase opposition to the signal of frequency $f_o$ induced in receiver coil 202 by coupling with coil 102. Accordingly, the bucking signal cancels or substantially attenuates the signal of frequency $f_o$ induced in receiver coil 202. Bucking coil 140 and the leads 141 connecting coil 140 to coil 202 are preferably electrostatically shielded, for example, by enclosing the windings of coil 140 in a layer of grounded aluminum foil (not shown) and employing shielded cable for leads 141.

Receiver coil 202 and bucking coil 140 are connected in parallel with tuning capacitor 204 to provide a receiver antenna circuit which is reasonant at $2f_o$. With a receiver coil 202 constructed as described above, tuning capacitor 204 may have a value of approximately 0.4 microfarads. The remainder of receiver circuit 200 is connected to one terminal of capacitor 204 by lead 205. The other terminal of capacitor 204 is connected to ground. Coil 202 and lead 205 are also preferably electrostatically shielded, again by enclosing the windings of coil 202 in a layer of grounded aluminum foil (not shown) and by employing shielded cable for lead 205.

Figure 8:
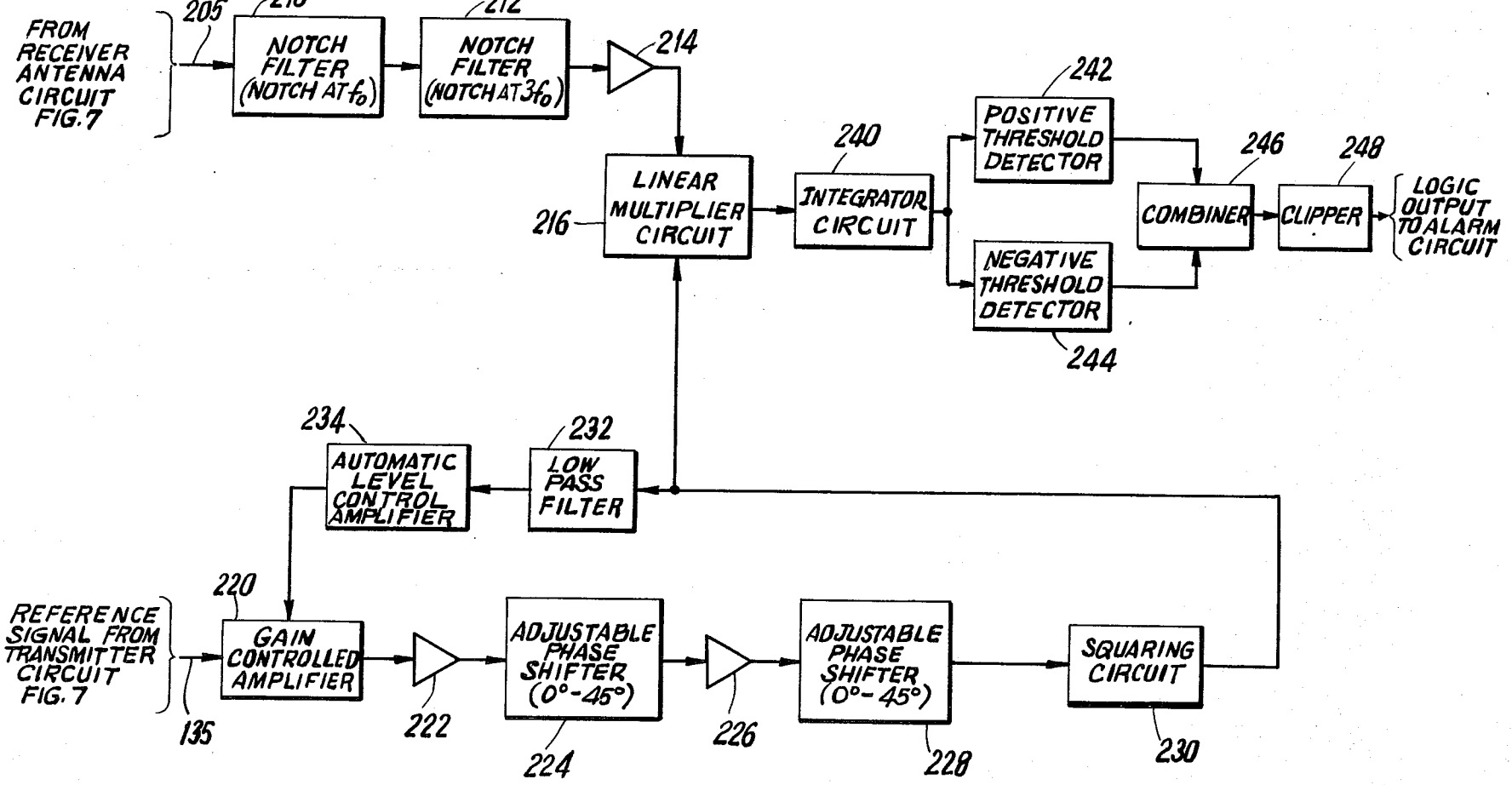
FIG. 8 is a schematic block diagram showing a further portion of the receiver apparatus of this invention in greater detail.

Further details of receiver circuit 200 are shown in FIG. 8. The output signal of the receiver antenna circuit is applied to notch filter 210 by way of lead 205. Notch filter 210 may be a twin-T filter having a notch at frequency $f_o$ for substantially attenuating any component of frequency $f_o$ in the output signal of the receiver antenna circuit. The output signal of notch filter 210 is applied to notch filter 212 which may be another twin-T notch filter having a notch at $3f_o$ for substantially attenuating any component of frequency $3f_o$ in the output signal of the receiver antenna circuit. The output signal of notch filter 212 is amplified by amplifier 214 which may include several amplification stages if desired. One or more of the stages of amplifier 214 may be adjustable. The output signal of amplifier 214 is applied to a first input terminal of linear multiplier circuit 216 for multiplication with a reference signal generated as discussed below and applied to the second input terminal of the multiplier circuit.

The signal on line 135 is a sinusoidal signal of frequency $f_o$ generated as described above in the discussion of FIG. 7. This signal is applied to the input terminal of gain controlled amplifier 220 in the receiver circuit of FIG. 8. The gain of amplifier 220 is controlled by the output signal of the feedback loop including elements 232 and 234 described below. The output signal of amplifier 220 is amplified by operational amplifier 222 and then applied to adjustable phase shifter 224. The output signal of phase shifter 224 is further amplified by operational amplifier 226 and then applied to a further adjustable phase shifter 228. The output signal of phase shifter 228 is applied to squaring circuit 230. Squaring circuit 230 produces an output signal which is the square of the applied signal. Since the reference signal on line 135 is a sinusoidal signal of frequency $f_o$, the output signal of squaring circuit 230 is a direct current (DC) signal plus a sinusoidal signal of frequency $2f_o$. This output signal is applied to the second input terminal of linear multiplier circuit 216 described above. The output signal of squaring circuit 230 is also applied to the input terminal of low pass filter 232 which passes only the DC component of the applied signal. The output signal of low pass filter 232 is applied to automatic level control amplifier 234 which scales the level of the output signal of filter 232 for use as a gain control signal for amplifier 220 described above. Accordingly, the DC component of the output signal of squaring circuit 230 is used to stabilize the reference signal circuit.

Phase shifters 224 and 228 are adjusted so that the phase of the sinusoidal component of the output signal of squaring circuit 230 is approximately either in phase with or 180° out of phase with the $2f_o$ frequency component of the output signal of amplifier 214 due to the presence of an active marker in the magnetic field generated by the transmitter apparatus. (Whether these two signal components are in phase or 180° out of phase for a given marker in the transmitted field will depend on the orientation or polarity of that marker in the transmitted field.) In general, this will require a shift of approximately 90° in the phase of the signal on lead 135 prior to squaring circuit 230 (i.e., approximately a 45° phase shift in each of phase shifters 224 and 228). The magnitude of the DC component of the output signal of multiplier 216 is a function of both the amplitude and phase of the signal of frequency $2f_o$ applied to the first input terminal of the multiplier. The sign of this DC component is determined by the phase of the $2f_o$ signal applied to the first input terminal of the multiplier. Other things being equal, the DC component of the multiplier output signal is most strongly positive when the $2f_o$ signal applied to the first multiplier input terminal is in phase with the $2f_o$ signal applied to the second multiplier input terminal. The DC component of the multiplier output signal is most strongly negative when the $2f_o$ signal applied to the first multiplier input terminal is 180° out of phase with the $2f_o$ signal applied to the second multiplier input terminal. Since the level of the DC component of the multiplier output signal is used as described below to indicate the presence of an active marker in the magnetic field produced by the transmitter apparatus, the receiver circuit shown in FIG. 8 discriminates against all received signal components of frequency $2f_o$ which are not of one of the two phases associated with the presence of an active marker in the transmitted field.

The output signal of multiplier 216 is applied to integrator circuit 240. Integrator circuit 240 has a time constant which is long relative to the period of the AC components of the multiplier output signal but short relative to the time typically required for a marker to pass through the magnetic field produced by the transmitter apparatus. For example, the time constant of integrator 240 may be approximately 0.22 seconds. Accordingly, integrator circuit 240 eliminates the AC components of the multiplier output signal and integrates the DC component of that signal with respect to time. The output signal of integrator 240 is applied to positive and negative threshold detectors 242 and 244. Threshold detectors 242 and 244 produce an output signal when the output signal of integrator 240 is respectively above or below predetermined positive or negative threshold values. These values are selected so that one or the other of threshold detectors 242 and 244 produces an output signal when an active marker having any of a substantial fraction (preferably a major fraction) of the possible locations and orientations is present in the magnetic field produced by the transmitter apparatus, but so that neither threshold detector produces an output signal when no active marker is present in the transmitted magnetic field. The output signals of threshold detectors 242 and 244 are combined by combiner circuit 246 which produces an output signal whenever either threshold detector produces an output signal. This signal is applied to clipper 248 (e.g., a Schmitt trigger) for rendering the output signal of combiner 246 suitable for use in driving an alarm circuit or other logical apparatus for initiating action appropriate to the occurrence of an act of pilferage when an active marker is detected in the magnetic field of the transmitter apparatus and one of threshold detectors 242 and 244 is accordingly triggered.

In accordance with the principles of this invention, a marker is deactivated when the marker control element 12 is substantially demagnetized. A marker control element can be demagnetized (e.g., from remanent magnetization at point A as shown in FIG. 2*a*) by applying an external magnetic field of polarity opposite to the polarity of the control element and magnitude slightly greater than the abscissa OB in FIG. 2*a*. This will cause the magnetization M of the control element to go from point A to slightly below zero along line 32 in FIG. 2*a*. When the external magnetic field is removed, M for the control element will go to zero and the marker is deactivated. This method of marker deactivation requires that the marker be exactly aligned with the deactivating magnetic field, which means in general that the marker must be physically located and properly oriented in the deactivation apparatus prior to application of the deactivating field. Alternatively, the deactivation apparatus can include apparatus for sensing the orientation and polarity of the marker and then applying a field with exactly the polarity and strength required to deactivate the marker. This however, necessitates fairly complicated and expensive deactivation apparatus.

A preferred method of deactivating markers in accordance with the principles of this invention is to apply a magnetic field of alternating polarity and gradually decreasing amplitude to the marker. This field must have a component in the plane of the marker control element which is initially sufficiently strong to magnetically saturate the control element with any orientation in the plane of the control element. Thereafter, as the deactivating field periodically reverses polarity with gradually diminishing amplitude, the magnetization of the control element gradually decays to zero along a collapsing hysteresis path. As long as control strip 12 is initially saturated by the deactivating field and as long as there is a sufficiently larger number of applied field reversals before the deactivating field decays to the point at which it has no further effect on the magnetization of the control strip, control strip 12 is always substantially demagnetized by the deactivating field regardless of the alignment of the marker in the applied field.

Figure 9:
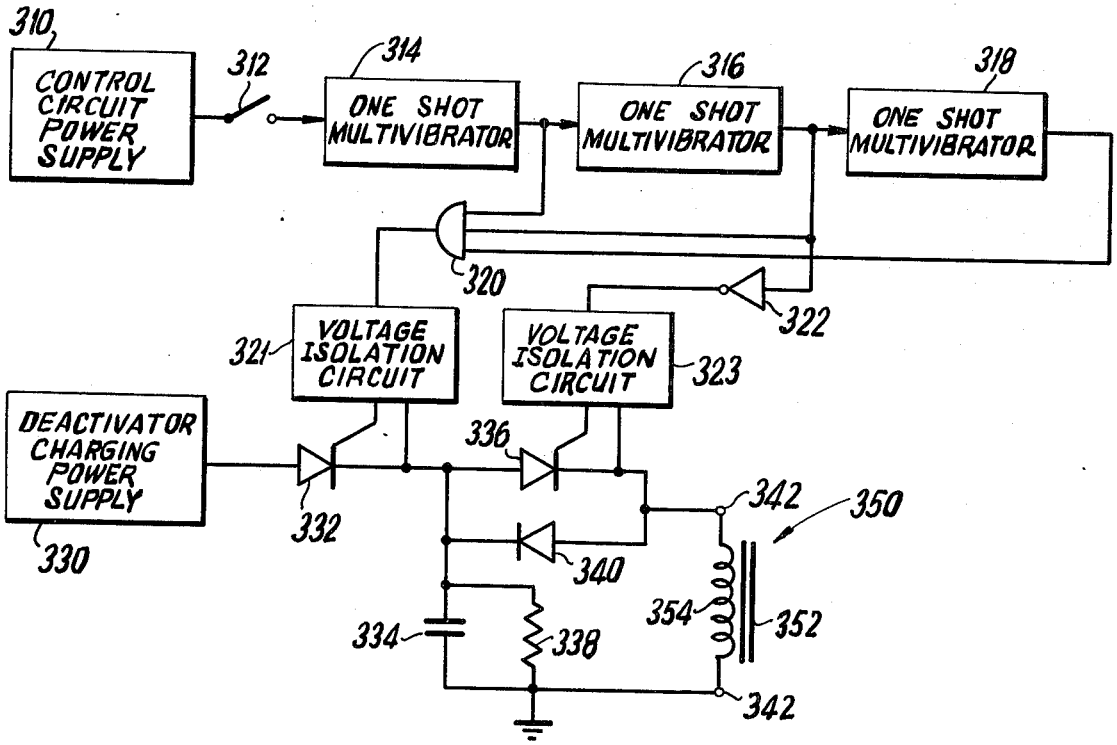
FIG. 9 is a schematic block diagram of a preferred embodiment of the marker deactivation apparatus of this invention.
Figure 10A:
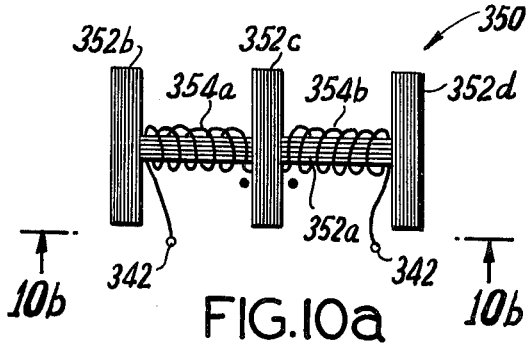
FIG. 10*a* is a partly schematic, partly plan view of an electromagnet constructed in accordance with the principles of this invention for use in the deactivation apparatus of FIG. 9.
Figure 10B:
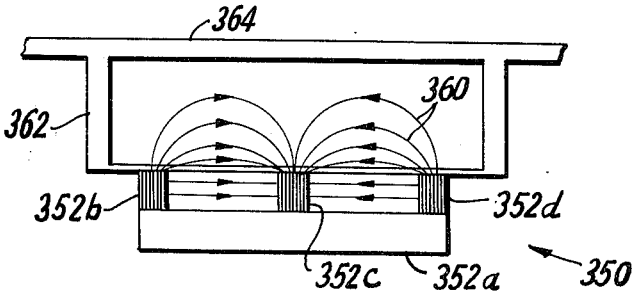
FIG. 10*b* is another view of the electromagnet of FIG. 10*a* taken along the line 10*b*—10*b* in that Figure and showing how the electromagnet may be mounted adjacent an enclosure for deactivating the marker associated with an article inserted in the enclosure.

FIG. 9 shows circuit apparatus constructed in accordance with the principles of this invention for generating a sinusoidal magnetic field of gradually diminishing amplitude for use in deactivating the markers of this invention in the preferred manner described above. FIGS. 10*a* and 10*b* show an electromagnet 350 constructed in accordance with the principles of this invention which is particularly desirable for use in the circuit of FIG. 9 to efficiently generate a strong magnetic field over a large area. In the deactivator circuit shown in FIG. 9, switch 312 is normally open. If desired, switch 312 can be replaced by a relay or an electronic logic gate and a signal from another source (e.g., a cash register) can be used to trigger the deactivation apparatus in a manner comparable to the closing of switch 312. When stiwch 312 is open, control circuit power supply 310 is disconnected from one shot multivibrator 314 and the output signals of all of one shot multivibrators 314, 316, and 318 are high or logical ONE. All of these multivibrator output signals are applied to AND gate 320 and the output signal of AND gate 320 is accordingly also high. The output signal of AND gate 320 controls the signal applied to the gate terminal of semiconductor controlled rectifier (SCR) 332 by voltage isolation circuit 321. As long as the output signal of AND gate 320 is high, SCR 332 is enabled or conducting and current flows from deactivator charging power supply 330 through SCR 332 to charging capacitor 334. The output signal of one shot multivibrator 316 is also applied to logical inverter 322 and the output signal of logical inverter 322 is applied to the gate of SCR 336 by way of voltage isolation circuit 323. Accordingly, as long as the output signal of multivibrator 316 is high, the output signal of inverter 322 is low and SCR 336 is disabled or non-conducting. Resistor 338 has a large value as discussed below so that while SCR 332 is conducting and SCR 336 is non-conducting, capacitor 334 is charged by the current flowing from deactivator charging power supply 330. Voltage isolation circuits 321 and 323 are used to provide appropriate SCR gate drive currents for SCR devices 332 and 336, respectively, and to isolate the relatively low voltage logic circuits from the relatively high voltages appearing on the SCR terminals during normal operation.

When a marker is to be deactivated, the marker (or article carrying or associated with the marker) is placed near the core 352 of electromagnet 350 and switch 312 is momentarily closed. The closing of switch 312 applies the output signal of power supply 310 to the input terminal of one shot multivibrator 314. This causes the output signal of multivibrator 314 to fall to the logical ZERO level for the characteristic time delay of the multivibrator. When the output signal of multivibrator 314 returns to the logical ONE level, multivibrator 316 is triggered and the output signal of that multivibrator falls to the logical ZERO level for the characteristic time delay of that device. Finally, when the output signal of multivibrator 316 returns to the logical ONE level, multivibrator 318 is triggered and the output signal of that device falls to the logical ZERO level for its characteristic time interval.

As soon as multivibrator 314 is triggered by the closing of switch 312, the output signal of AND gate 320 falls to the logical ZERO level and SCR 332 is cut off. This stops the charging of capacitor 334 from power supply 330. SCR 332 remains cut off while the output signal of any of multivibrators 314, 316, or 318 is logical ZERO (i.e., until after the output signal of multivibrator 318 has returned to the logical ONE level). After a predetermined time interval (i.e., the characteristic delay of multivibrator 314), multivibrator 316 is triggered and the output signal of that device drops to the logical ZERO level as described above. This signal is inverted by inverter 322 which results in the application of a gate enabling signal to SCR 336. SCR 336 is thereby rendered conducting and current flows from capacitor 334 through SCR 336 to the coil 354 of electromagnet 350. The characteristic time delay of multivibrator 314 is selected to be sufficiently long (typically at least about 17 milliseconds) to insure that SCR 332 is turned off before SCR 336 is turned on. (The coil 354 of electromagnet 350 is connected to the rest of the circuit of FIG. 9 at terminals 342.) As long as SCR 336 is conducting, capacitor 334 and coil 354 form a ringing LC circuit with current alternately flowing from the upper terminal of capacitor 334 as viewed in FIG. 9 to the upper terminal of coil 354 through SCR 336 and in the opposite direction through diode 340. The resulting alternating current through coil 354 causes electromagnet 350 to generate a magnetic field of alternating polarity. The resistive losses in elements 334, 336, 340, and 354 cause the amplitude of the signal in the ringing circuit to gradually decrease. Electromagnet 350 therefore produces a magnetic field of periodically reversing polarity and gradually decreasing amplitude as is required to demagnetize and therefore deactivate markers in the preferred manner of this invention. Resistor 338, connected across capacitor 334, has a large value of resistance and is provided to discharge capacitor 334 when the apparatus is not in use, thereby assuring safe serviceability of the circuit.

Capacitor 334, electromagnet 350, and devices 336 and 340 are selected so that a substantial number of oscillations occurs in the deactivating magnetic field before the amplitude of that field decreases to the point at which the field has no further effect on the control strip of a marker. The characteristic time delay of multivibrator 316 is selected to allow at least sufficient time for this number of oscillations to occur. Thereafter, the output signal of multivibrator 316 returns to the logical ONE level and SCR 336 is turned off. This terminates oscillation in the ringing circuit and triggers multivibrator 318. After a short time delay introduced by multivibrator 318, (e.g., to insure that SCR 336 is turned off before SCR 332 is turned on), the output signal of AND gate 320 returns to the logical ONE level. This turns on SCR 332, allowing capacitor 334 to recharge from power supply 330. When capacitator 334 is recharged, the deactivator is ready to deactivate another marker when switch 312 is again momentarily closed.

As mentioned above, FIGS. 10*a* and 10*b* are two views of an electromagnet 350 which can be used in the deactivating circuit of FIG. 9 to efficiently produce a large magnetic field in a relatively large volume adjacent the electromagnet. The electromagnet shown in FIGS. 10*a* and 10*b* includes a core 352*a* and three pole pieces 352*b*, *c*, and *d* all made of laminated silicon steel with laminations perpendicular to the plane of the paper as viewed in FIG. 10*a*. Each of pole pieces 352*b*, *c*, and *d* is mounted on one surface of core 352*a* so that all of the pole pieces are perpendicular to the longitudinal axis of core 352*a* and parallel to one another. Pole pieces 352*b* and 352*d* are mounted near the ends of core 352*a*. Pole piece 352*c* is mounted midway between the other two pole pieces. Coil segments 354*a* and *b* (hereinafter referred to simply as coils 354*a* and *b*) are respectively mounted on core 352*a* on either side of pole piece 352*c*. Coils 354*a* and *b* are connected in series and wound on core 352*a* so that when a current is passed through the coils, the ends of core 352*a* are polarized oppositely from the mid-section of the core. Accordingly, end pole pieces 352*b* and 352*d* are polarized alike while middle pole piece 352*c* is oppositely polarized. A portion of the external magnetic field thus produced by electromagnet 350 is represented by lines of force 360 shown in FIG. 10*b*. Reversal of the flow of current through coils 354*a* and *b* reverses the direction of these lines of force. Pole pieces 352*b*, *c*, and *d* serve to distribute the field produced in core 352*a* over at least the length of the pole pieces, thereby producing a strong and fairly uniform magnetic field throughout the volume above the electromagnet as viewed in FIG. 10*b*. As noted above, the initial amplitude of this field is preferably great enough to substantially saturate the control element of a marker having substantially any orientation in the field. Although the electromagnet shown specifically in FIG. 10*a* includes only three pole pieces and two coil segments, it will be understood that an electromagnet of this type can be made with any number of pole pieces and intermediate coil segments to produce a magnetic field of any size.

If desired, electromagnet 350 can be mounted adjacent an enclosure 362 as shown in FIG. 10*b* which is coextensive with the portion of the field of electromagnet 350 which is strong enough to demagnetize the control element of a marker. This enclosure can be located below a portion of the counter 364 where articles are brought prior to authorized removal from the protected area. When the article has been authorized for removal from the protected area, it is momentarily placed in enclosure 362 (e.g., by a salesclerk) and the circuit of FIG. 9 is activated by closing switch 312 as described above. This deactivates the marker associated with the article so that the article can be removed from the protected area without the marker being detected by the detection apparatus described above. Alternatively, the deactivation apparatus can be mounted such that pole pieces are immediately below the counter surface with the limits of the deactivation zone outlined on the top surface of the counter. In this way, the amounts of motion and time required of the person performing the deactivation process are minimized. If desired, apparatus can be provided for verifying that a marker has been successfully deactivated. This apparatus can be a small-scale version of the marker detection apparatus. For example, the transmitting and receiving coils of this verification apparatus can be mounted on opposite sides of an enclosure similar to enclosure 362, preferably near the deactivator.

In an illustrative embodiment of an electromagnet of the type shown in FIGS. 10*a* and 10*b*, core 352*a* is 20 inches long, 2½ inches high, and 2½ inches thick as viewed in FIG. 10*b* and made up of approximately 170 laminations of silicon steel. Each of pole pieces 352*b*, *c*, and *d* is 8 inches long. Pole pieces 352*b* and *d* are each 2½ inches high and 2½ inches thick as viewed in FIG. 10*b* and made up of approximately 170 laminations of silicon steel. Pole piece 352*c* is 2½ inches high and 3 inches thick and made up of approximately 204 laminations of silicon steel. Each of coils 354*a* and *b* is made up of 100 turns of No. 7 square copper wire. This electromagnet can be used to deactivate markers such as the one specifically described above in conjunction with a deactivator circuit as shown in FIG. 9 including a capacitor 334 of 1300 microfarads initially charged to approximately 350 volts. In this circuit, capacitor 334 and electromagnet 350 resonate at approximately 40 Hz with a Q of between 10 and 15. Oscillations of the circuit are essentially complete after about 500 milliseconds (i.e., about 40 field reversals). The time constant of multivibrator 316 can therefore be approximately 500 milliseconds. The time constants of multivibrators 314 and 318 can be 17 and 30 milliseconds respectively.

What is claimed is:

1. A system for detecting removal of articles from a protected area comprising:

a magnetic marker associated with each article, each marker including a remanently magnetized control element of relatively high coercivity and a switching element of relatively low coercivity, at least a portion of which is magnetized by said remanently magnetized control element in the absence of other magnetic fields of sufficient strength to counteract the effect of said remanently magnetized control element;

means for generating a periodic magnetic field in a region through which an article must pass to leave the protected area for periodically altering the magnetization of the switching element of a marker in said region, said periodic magnetic field having a first frequency and being free of a detectable amount of a predetermined even harmonic of said first frequency;

means for detecting said predetermined even harmonic of said first frequency in the magnetic field produced by the switching element of a marker in response to said periodic magnetic field; and means for demagnetizing the control element of a marker sufficiently to preclude the aforesaid production of said predetermined even harmonic when the associated article is to leave the protected area undetected.

2. The system defined in claim 1 wherein the remanent magentization of the control element of a marker is the magnetization which remains after the control element has been magnetically saturated.

3. The system defined in claim 1 wherein the switching element of a marker is magnetically saturated by the magnetic force exerted by the remanently magnetized control element of the marker in the absence of other magnetic fields of sufficient strength to counteract the effect of said remanently magnetized control element.

4. The system defined in claim 1 wherein the control element of each of said markers is made of a material selected from the group consisting of Vicalloy, consisting essentially of approximately 52% cobalt, 10% vanadium, and 38% iron, and Remendur, consisting essentially of approximately 49% cobalt, 3.5% vanadium, and 47.5% iron, and wherein the switching element of each marker is Permalloy, consisting essentially of approximately 79% nickel, 17% iron, and 4% molybdenum.

5. The system defined in claim 1 wherein said means for generating a periodic magnetic field comprises:

means for generating a periodic electrical signal having said first frequency and being free of a detectable amount of said predetermined even harmonic of said first frequency; and a transmitter antenna coil connected to said means for generating a periodic electrical signal.

6. The system defined in claim 1 wherein said means for detecting said predetermined even harmonic of said first frequency comprises:

a receiver antenna coil disposed in the magnetic field produced by said means for generating a periodic magnetic field; and a detector circuit connected to said receiver antenna coil for detecting a signal in said receiver antenna coil having said predetermined even harmonic frequency and for producing an output signal indicating that an article is being removed from the protected area in response thereto.

7. The system defined in claim 6 wherein said detector circuit comprises:

amplifier means for selectively amplifying the component of the signal in said receiver antenna coil having said predetermined even harmonic frequency;

means responsive to said means for generating a periodic electrical signal for generating a reference signal having said predetermined even harmonic frequency and being either in phase with or 180° out of phase with the output signal component of said amplifier means having said predetermined even harmonic frequency and resulting from the presence of a marker with a remanently magnetized control element in the field of said transmitter antenna coil;

means for multiplying the output signals of said amplifier means and said means for generating a reference signal;

integrator means for integrating the output signal of said means for multiplying; and means for producing said output signal indicating that an article is being removed from the protected area when the output signal of said integrator means reaches a certain predetermined level.

8. The system defined in claim 1 wherein said means for demagnetizing the control element of a marker comprises means for producing a magnetic field of alternating polarity and diminishing amplitude.

9. A system for detecting pilferage of articles from a protected area comprising:

a magnetic marker associated with each article, each marker including a first longitudinal marker element of magnetic material which is magnetically relatively soft and a second marker element of magnetic material which is magnetically relatively hard, said second marker element being disposed adjacent said first marker element and being remanently magnetized in a direction parallel to the longitudinal axis of said first marker element when said marker is active to protect the associated article from pilferage, the magnetic force exerted by said second marker element on said first marker element when said marker is active being great enough to magnetize at least a portion of said first marker element but not great enough to prevent reversal of the polarity of said portion of said first marker element by an external magnetic field of magnitude less than the magnitude required to affect the magnetization of said second marker element;

means for generating a magnetic field of alternating polarity in an area through which an article associated with a marker must pass to leave the protected area, said alternating magnetic field having a predetermined fundamental frequency and being free of a detectable amount of a predetermined even harmonic of said fundamental frequency, the amplitude of said alternating magnetic field being great enough to cause reversal of the polarity of the first element of an active marker entering said field during a portion of each period of oscillation of said alternating magnetic field for at least a fraction of the possible locations and orientations of said marker in said alternating magnetic field, the amplitude of said alternating field being insufficient to affect the magnetization of the second element of said marker to such a degree as to cause a detectable change in the operation of said marker for any of the possible locations and orientations of said markers in said field;

means for detecting said predetermined even harmonic of said fundamental frequency in the magnetic field produced by the first element of an active marker in said alternating magnetic field; and means for demagnetizing the second element of a marker sufficiently to preclude the aforesaid production of said predetermined even harmonic when the associated article is authorized for removal from the protected area to permit the article and the associated marker to pass through said alternating magnetic field without said marker producing said predetermined even harmonic of said fundamental frequency detected by said means for detecting.

10. The system defined in claim 9 wherein the remanent magnetization of the second element of an active marker is the magnetization which remains after the second element has been magnetically saturated.

11. The system defined in claim 10 wherein the first element of an active marker is magnetically saturated by the magnetic force exerted by said second element in the absence of other magnetic fields of sufficient strength to counteract the effect of said remanently magnetized control element.

12. The system defined in claim 9 wherein the first element of each of said markers is a strip of Permalloy, consisting essentially of approximately 79% nickel, 17% iron, and 4% molybdenum, having a predetermined length, width, and thickness and wherein said second element of each marker is a strip of Vicalloy, consisting essentially of approximately 52% cobalt, 10% vanadium, and 38% iron, having the same width and thickness as said first element and having length one third the length of said first element.

13. The system of claim 12 wherein the second element of each of said markers is disposed adjacent the first element of said marker in a plane parallel to the plane of said first element with the ends of said second element overlying the third points dividing the length of said first element.

14. The system defined in claim 13 wherein the first element of each of said markers is 3 inches long, 1 inch wide, and 0.002 inch thick and the second element of each marker is 1 inch long, 1 inch wide, and 0.002 inch thick.

15. The system defined in claim 9 wherein the first element of each of said markers is a strip of Permalloy, consisting essentially of approximately 79% nickel, 17% iron, and 4% molybdenum, having a predetermined length, width, and thickness and wherein said second element of each marker is a strip of Remendur, consisting essentially of approximately 49% cobalt, 3.5% vanadium, and 47.5% iron, having the same width and half the thickness of said first element and having length one third the length of said first element.

16. The system defined in claim 15 wherein the second element of each of said markers is disposed adjacent the first element of said marker in a plane parallel to the plane of said first element with the ends of said second element overlying the third point dividing the length of said first element.

17. The system defined in claim 16 wherein the first element of each of said markers is 3 inches long, 1 inch wide, and 0.002 inch thick and the second element of each marker is 1 inch long, 1 inch wide, and 0.001 inch thick.

18. The system defined in claim 9 wherein said means for generating an alternating magnetic field comprises:

means for generating an alternating current electrical signal having said fundamental frequency and being free of a detectable amount of said predetermined even harmonic of said fundamental frequency; and a transmitter antenna circuit connected to said means for generating an alternating current electrical signal, said antenna circuit including a planar transmitter antenna coil and a transmitter antenna tuning capacitor, said transmitter antenna circuit being resonant at said fundamental frequency.

19. The system defined in claim 18 wherein said means for generating an alternating current electrical signal comprises:

an oscillator for producing a sinusoidal output signal of said fundamental frequency;

a power amplifier for amplifying the output signal of said oscillator to produce a signal for driving said transmitter antenna circuit; and a feedback circuit from the output to the input of said power amplifier for amplifying the output signal component of said power amplifier having said predetermined even harmonic frequency and feeding said amplified output signal component back to the input of said power amplifier in phase opposition to said amplified output signal component to attenuate said even harmonic frequency component in the output signal of said power amplifier.

20. The system defined in claim 18 wherein said means for detecting said predetermined even harmonic comprises:

a receiver antenna circuit including a planar receiver antenna coil disposed in a plane substantially parallel to the plane of said transmitter antenna coil and a receiver antenna tuning capacitor, said receiver antenna circuit being resonant at said predetermined even harmonic of said fundamental frequency; and a detector circuit connected to said receiver antenna circuit for detecting a signal in said receiver antenna circuit having said predetermined even harmonic frequency and for producing a pilferage indicating output signal in response thereto.

21. The system defined in claim 20 wherein said receiver antenna circuit further comprises a bucking coil would with the transmitter antenna coil and connected between terminals of said receiver antenna coil and said receiver antenna tuning capacitor so that the signal of said fundamental frequency induced in said bucking coil is in phase opposition to, and substantially attenuates, the signal of said fundamental frequency induced in said receiver antenna circuit by coupling to said transmitter antenna circuit.

22. The system defined in claim 20 wherein said detector circuit comprises:

amplifier means for selectively amplifying the component of the signal in said receiver antenna circuit having said predetermined even harmonic frequency;

means responsive to the output signal of said power amplifier for generating a reference signal having said predetermined even harmonic frequency and phase adjusted to either match or oppose the phase of the amplified receiver antenna circuit signal component of the same frequency produced by the presence of an active marker in the field of the transmitter antenna circuit;

means for multiplying the output signals of said amplifier means and said means for generating a reference signal;

integrator means for integrating the output signal of said means for multiplying;

positive and negative threshold detecting means for respectively producing an output signal when the output signal of said integrator means is respectively above a predetermined positive threshold or below a predetermined negative threshold; and combiner means for producing said pilferage indicating output signal in response to an output signal from either of said positive and negative threshold detecting means.

23. The system defined in claim 22 wherein said predetermined even harmonic frequency is the second harmonic of said fundamental frequency and wherein said means for generating a reference signal comprises:

means for producing a signal proportional to the output signal of said power amplifier;

means for shifting the phase of said proportional signal by 90°; and means for squaring said shifted signal.

24. The system defined in claim 9 wherein said means for demagnetizing the second element of a marker comprises:

an electromagnet including core means and coil means; and means connected in circuit relation with said coil means of said electromagnet for producing in said coil means a periodic electrical signal of gradually diminishing amplitude to cause said electromagnet to produce a periodic magnetic field of gradually diminishing amplitude for gradually demagnetizing the second element of a marker in the proximity of said electromagnet.

25. The apparatus defined in claim 24 wherein the core means of said electromagnet includes a longitudinal core member and a plurality of longitudinal pole piece members mounted on said core member, the longitudinal axes of said pole piece members being parallel to one another and perpendicular to the longitudinal axis of said core member, said pole piece members being spaced along the length of said core member, and wherein the coil means of said electromagnet includes a plurality of coils, each wound around said core means between adjacent pairs of pole pieces, said coils being wound and interconnected so that adjacent pole pieces are oppositely polarized by a current through said coil means.

26. The system defined in claim 24 wherein said means connected in circuit relation with said coil means comprises:

a power supply;

a charging capacitor having a first terminal connected to a first terminal of said coil means;

first switch means for passing current from said power supply to a second terminal of said charging capacitor when said first switch means is enabled;

second switch means for passing current from said second terminal of said charging capacitor to a second terminal of said coil means when said second switch means is enabled;

a diode for passing current from said second terminal of said coil means to said second terminal of said charging capacitor; and control circuit means for normally enabling said first switch means and disabling said second switch means to charge said charging capacitor with current from said power supply, said control circuit further including control switch means and sequencing means responsive to actuation of said control switch means for producing output signals for sequentially disabling said first switch means, enabling said second switch means, disabling said second switch means, and re-enabling said first switch means to connect said charging capacitor and said coil means in ringing circuit relation while said second switch means is enabled.

27. For use in a pilferage detection system in which a magnetic marker associated with an article to be protected from pilferage is detected when the marker is active and the associated article enters an alternating magnetic field by a characteristic of the magnetic field produced by the marker in response to the alternating magnetic field, an improved magnetic marker comprising: a first longitudinal element of magnetic material which is magnetically relatively soft and a second element of magnetic material which is magnetically relatively hard, said second element being disposed adjacent said first element and being remanently magnetized parallel to the longitudinal axis of said first element when said marker is active and demagnetized when said marker is inactive, the magnetic force of said second element on said first element when said marker is active being great enough to magnetize a portion of said first element but not great enough to prevent reversal of the polarity of said portion of said first element by a properly aligned external magnetic field of magnitude less than the magnitude required to affect the magnetization of said second marker element.

28. The improved magnetic marker defined in claim 27 wherein the remanent magnetization of said second element when said marker is active is the magnetization which remains after said second element has been magnetically saturated.

29. The improved magnetic marker defined in claim 28 wherein said first element is magnetically saturated by the remanent magnetization of said second element when said marker is active and in the absence of other magnetic fields of sufficient strength to counteract the effect of said remanently magnetized control element.

30. The improved magnetic marker defined in claim 27 wherein said first element is a strip of Permalloy, consisting essentially of approximately 79% nickel, 17% iron, and 4% molybdenum, having a predetermined length, width, and thickness and wherein said second element is a strip of Vicalloy, consisting essentially of approximately 52% cobalt, 10% vanadium, and 38% iron, having the same width and thickness as said first element and having length one-third the length of said first element.

31. The improved magnetic marker defined in claim 30 wherein said second element is disposed adjacent said first element in a plane parallel to the first element, the ends of said second element overlying the third points dividing the length of said first element.

32. The improved magnetic marker defined in claim 31 wherein said first element is 3 inches long, 1 inch wide, and 0.002 inch thick and wherein said second element is 1 inch long, 1 inch wide, and 0.002 inch thick.

33. The improved magnetic marker defined in claim 29 wherein said first element is a strip of Permalloy, consisting essentially of approximately 79% nickel, 17% iron, and 4% molybdenum, having a predetermined length, width, and thickness and wherein said second element is a strip of Remendur, consisting essentially of approximately 49% cobalt, 3.5% vanadium, and 47.5% iron, having the same width and thickness as said first element and having length one-third the length of said first element.

34. The improved magnetic marker defined in claim 33 wherein said second element is disposed adjacent said first element in a plane parallel to the first element, the ends of said second element overlying the third points dividing the length of said first element.

35. The improved magnetic marker defined in claim 34 wherein said first element is 3 inches long, 1 inch wide, and 0.002 inch thick and wherein said second element is 1 inch long, 1 inch wide, and 0.001 inch thick.

36. The improved magnetic marker defined in claim 29 wherein said first element is a strip of Permalloy, consisting essentially of approximately 79% nickel, 17% iron, and 4% molybdenum, 3 inches long, 1 inch wide, and 0.002 inch thick, wherein said second element is a strip of Vicalloy, consisting essentially of approximately 52% cobalt, 10% vanadium, and 38% iron, 1 inch long, 1 inch wide, and 0.002 inch thick, and wherein said second element is disposed adjacent said first element so as to overlie the central portion of the length of said first element.

37. The improved magnetic marker defined in claim 29 wherein said first element is a strip of Permalloy, consisting essentially of approximately 79% nickel, 17% iron, and 4% molybdenum, 3 inches long, 1 inch wide, and 0.002 inch thick, wherein said second element is a strip of Remendur, consisting essentially of approximately 49% cobalt, 3.5% vanadium, and 47.5% iron, 1 inch long, 1 inch wide, and 0.001 inch thick, and wherein said second element is disposed adjacent said first element so as to overlie the central portion of the length of said first element.

* * * * *